United States Patent [19]

Klages et al.

[11] 4,020,892

[45] May 3, 1977

[54] METHOD FOR CONTINUOUS CASTING OF STEEL

[75] Inventors: Robert Klages, Dortmund; Heinrich Kleeschulte, Dortmund-Barop, both of Germany

[73] Assignee: Hoesch Aktiengesellschaft, Dortmund, Germany

[22] Filed: Nov. 17, 1975

[21] Appl. No.: 632,378

Related U.S. Application Data

[63] Continuation-in-part of Ser. No. 306,715, Nov. 15, 1972, Pat. No. 3,866,662, and a continuation-in-part of Ser. No. 530,400, Dec. 6, 1974, abandoned.

[30] Foreign Application Priority Data

Nov. 16, 1971 Germany ..... 2156768

[52] U.S. Cl. ..... 164/89; 164/123; 164/128

[51] Int. Cl.[2] ..... B22D 11/10; B22D 11/16

[58] Field of Search ..... 164/55, 56, 82, 123, 164/126, 128, 274, 281, 89

[56] References Cited

UNITED STATES PATENTS

| | | | |
|---|---|---|---|
| 2,304,258 | 12/1942 | Junghans | 164/89 |
| 2,401,075 | 5/1946 | Humes | 164/126 |
| 2,402,833 | 6/1946 | Mumma et al. | 164/126 X |
| 2,825,947 | 3/1958 | Goss | 164/274 X |
| 3,315,323 | 4/1967 | Speith et al. | 164/123 X |
| 3,318,363 | 5/1967 | Goss | 164/123 X |
| 3,866,662 | 2/1975 | Klages et al. | 164/123 |

FOREIGN PATENTS OR APPLICATIONS

| | | | |
|---|---|---|---|
| 1,289,961 | 2/1969 | Germany | 164/123 |
| 570,097 | 12/1957 | Italy | 249/79 |
| 967,032 | 8/1964 | United Kingdom | 164/56 |

*Primary Examiner*—Ronald J. Shore
*Attorney, Agent, or Firm*—Walter Becker

[57] ABSTRACT

A method of casting quiet steel in a mold according to which prior to the casting of casting powder with a bulk weight of from 250 to 705 gr/liter and in a quantity of from 1 to 3 kg/ton of steel is introduced into the mold at a distance of from 5 to 50 cm from the base of the mold, and in which when the liquid steel level reaches the desired height the slag layer is instantaneously and completely covered with water whereby the entire slag layer solidifies and lifts itself off the steel level so that the latter is contacted by the water.

8 Claims, 5 Drawing Figures

Fig. 1

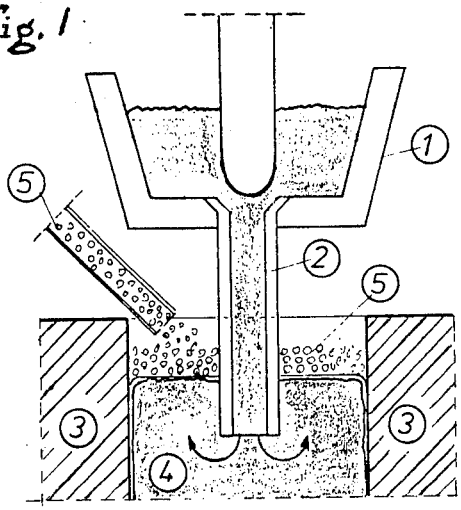

1 tundish
2 submerged nozzle
3 mold
4 liquid steel
5 casting powder
6 water-spray Normal continuous casting. Casting powder addition, powder thickness appr. 30 mm

Fig. 2

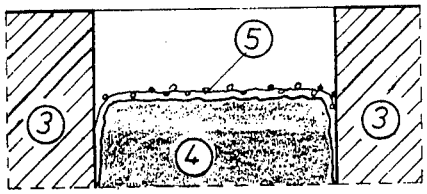

Layer of almost fully molten casting powder, appr. 10 mm thickness

Fig. 3

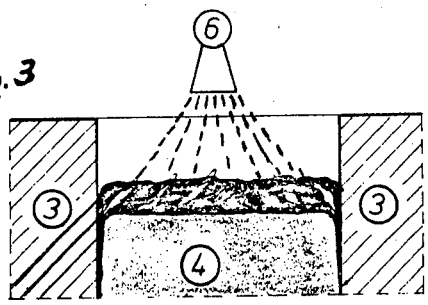

Immediate first water addition, water-thickness appr. 30 mm. The slag-layer solidifies, disintegrates into small fragments and lifts off from the steel-level

Fig. 4

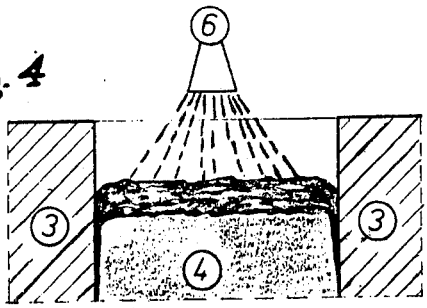

Second water-addition for cooling and sealing off the cast strand

METHOD FOR CONTINUOUS CASTING OF STEEL

This is a continuation-in-part of allowed co-pending application Ser. No. 306,715— Klages et al, filed Nov. 15, 1972, now U.S. Pat. No. 3,866,662— Klages et al issued Feb. 18, 1975 and belonging to the assignee of the present invention and a further now abandoned continuation-in-part of co-pending application Ser. No. 530,400— Klages et al filed, Dec. 6, 1974 belonging to the assignee of the present invention.

The present invention relates to a method of casting quiet or dead steel in molds to form ingots, blocks or slabs while utilizing casting powders.

Methods for bottom pouring of quiet steel are known. Of these known methods, to methods are employed in order according to an economic operation to produce qualitatively satisfactory steel ingots, blocks and slabs and to reduce possible inner and outer faults to a minimum. According to the first one of these known methods, which is also called chill casting, a forced solidification of the ingot, block or slab head is obtained by quenching with sufficient quantities of water. In this connection, the shrinking occurring in the interior of the ingot, block or slab is partly compensated for by a controlled post casting of steel. The modifications possible with this method are limited as to time covering the phase from pouring to forced solidification. While an improvement in the quality of the ingots, blocks or slabs is obtained by certain steps, as for instance, by varnishing and covering the molds, by adding tar or naphthalene during the casting operation, the stirring of the steel level near the walls of the molds, or the insertion of floating frames, it is, however not possible by means of these steps to assure a surface quality of the ingots, blocks or slabs which would meet modern requirements.

This insufficient surface quality of steel ingots, blocks or slabs produced in conformity with the so-called chill casting was one of the reasons for introducing the method known as hot top casting with casting powder according to which the steel is cast underneath a layer of casting powder, and the solidification of the ingot top is delayed in the so-called hot tops. With this method, the purpose of the casing powder consists in avoiding by its insulating effect heat losses by radiation and the capping or top freezing inherent thereto, and furthermore consists in forming one or more viscous slag phases depending on the composition at the phase border steel-casting powder layer, which slag phase is adapted in conformity with the layer thickness and the wetting effect to take up the deoxidation products and other impurifications ascending from the steel. The melting behavior and viscosity of the casting powder is, in part, so adjusted that the slag will at the respective height of the steel level fully wet the mold walls and will, during the rising of the steel, flow into the gap between the steel meniscus and mold. As a result thereof, a complete surrounding of the block by a slag layer will be obtained, which slag layer will then prevent a direct contact between the mold wall and the steel and will make surface damaging influences at said contacting surface impossible for all practical purposes. The added quantity of casting powder is so selected that with the intended melting speed still with the entrance into the hot top a sufficient thickness of the layer remains. The hot tops keep the ingots, block or slabs in liquid condition for a longer period than is the case with the first mentioned method, the chill casting method; accordingly; the shrinking of the steel in the lower block range caused by the starting solidification can be in part compensated for by the liquid component from the head range. Pouring below a casting powder due to the necessary large hood volume automatically causes a considerable proportion of head waste. In addition, thereto, the delayed solidification of the ingot, block or slab head makes necessary considerably extended periods of keeping the blocks or slabs in the molds. This factor leads to undesired liquation or segregation and at certain temperature ranges, for instance, with aluminum containing steels alloyed with from 1 to 1.5 manganese causes the well-known tears.

It is an object of the present invention to provide a method of the above mentioned general type by means of which the drawbacks of heretofore known methods will be avoided and by means of which the output of rolled steel will be increased in a simple manner while a high surface quality of the ingots, blocks and slabs will be assured. The above outlined objects have been realized by the method according to the present invention which is characterized by the combination of the following steps:

a. Prior to the start of the casting, at a distance of from 5 to 50 centimeters, preferably 20 to 40 centimeters from the foot of the mold, the casting powder is introduced into the mold with a bulk weight of pouring weight from 250 to 750 grams per liter, preferably 300 to 500 grams per liter and in a quanity of from 1 to 3 kilograms per ton of steel;

b. When the desired steel block or slab height has been reached which is indicated, for instace, by the liquid steel level reaching a certain marking in the mold, the molten slag layer involving the completely used-up casting powder is instantaneously and completely covered with water on the steel level so that the entire slag layer solidifies, lifts itself off from the steel level and the steel level is contacted by the water. According to a further development of the invention, advantageously, prior and/or during and/or after the pouring in of the water onto the slag layer, further steel is poured again in a continuous or batch-wise manner for making up the shrinking of the block or slab head.

According to an expedient and advantageous way, the method according to the invention is practiced in such a manner that a quantity of approximately from 1 to 2.4 kilograms of casting powder per ton of raw steel is introduced into the mold and quantity of from 1 to 1.5 liters of water more than during the water casting is sprayed onto the molded slag layer per kilogram of the slag formed on the block surface.

According to a preferred method of the invention, for purposes of obtaining a block or slab with a proper surface and in order to avoid sources of errors during the casting operation, for instance, to avoid the formation of pouring cones of the casting powder on the steel level, a carbon-free casting powder with a humidity content of approximately 1% is added which casting powder has the following composition:

From 50 to 60% of blast furnace slag,
From 30 to 40% of pearlite, and
From 0 to 10% of fluxing agent, said casting powder having a chemical analysis of substantially:

20 to 30% CaO
42 to 50% SiO
8 to 14% $Al_2O_3$

3to 8% MgO
0 to 6% $Na_2O$ or $B_2O_3$
0 to 3% $K_2O$

This carbon-free casting powder is introduced into the mold with a complete fusion occurring at a temperature of less than 360° C. As fluxing agent with this composition there may be employed preferably soda or colemanite (calciumborate).

The advantages of the method according to the invention are seen particularly in the fact that with a considerably reduced proportion in head scrap with a considerably reduced liquation in the block or slab head, and a correspondingly increased output in rolling steel, at the same time and in a simple manner there is obtained a highly satisfactory surface quality of the blocks and slabs whereby the dispatch of proper rolling material is clearly increased.

Furthermore, it is possible at the same time better to divide up the content of a casting ladle by producing any desired raw block or slab length thereby obtaining a reduction in the no longer rollable residual blocks. In view of the raw block height being variable to a great extend, according to the present invention, there is obtained the possibility of reducing the number of mold types. Since according to the invention, it is no longer necessary to isolate the block head, hoods and cover powder become superfluous. Consequently, also the residual quantities of substances for aiding the casting operation which increase the wear of the pit furnace and recuperators are greatly reduced. Furthermore, the considerably shortened exposure or standing time of the molds until the solidification of the blocks and slabs result on one hand in an increased life of the molds and a relief of the casting pits, and on the other hand result in a reduction of the heat-up time in the pit furnaces in view of the possible hotter insertion of the raw steel blocks into the pit furnaces. Although the method according to the invention is preferably employed with bottom pouring or uphill casting of quiet steel in molds, it also has advantages in connection with continuous casting. These advantages consist in that the quantity of slag to be removed from the steel strand is reduced, and that it is no longer necessary to remove the slag prior to the water quenching of the hot strand.

The method of casting quiet steel will now be explained in connection with the following

EXAMPLE

From an open hearth furnace there were tapped at a temperature of 1620° C and quieted in a casting ladle 80 tons of raw steel of a carbon-manganese fine grain steel for heavy plates with a melting analysis of:

0.18% of carbon
0.42% of silicon
1.35% of manganese
0.27% of phosphorous
0.020% of sulfur
0.040% of aluminum From the rolling mill there were ordered six slabs of 12 tons each from 12 ton molds and a residual block of at least 3 tons. The required molds were divided up into three mold groups of two molds each.

Prior to the start of the casting, at a distance of 30 centimeters from the bottom, four bags each with 5 kilograms of casting powder, corresponding to a quantity of 1.67 kilograms of casting poweder per ton of raw steel were suspended in the molds.

The casting powder consisting of approximately 60% of blast furnace slag, 35% pearlite, and 5% of soda with a melting flux occurring between 1220° to 1240° C had the following compositions A and B respectively:

| Fe ges. | FeO | MnO | $P_2O_5$ | CaO | $SiO_2$ | $Al_2O_3$ | |
|---|---|---|---|---|---|---|---|
| A) 0.94 | 1.21 | 0.69 | 0.044 | 28.0 | 45.3 | 10.0 | |
| B) 0.82 | 0.76 | 0.65 | 0.042 | 26.5 | 46.0 | 10.0 | |
| MgO | $TiO_2$ | C | $CO_2$ | $H_2O$ | S ges. | $Na_2O$ | $K_2O$ |
| A) 4.5 | 0.70 | — | 2.13 | 0.85 | 0.92 | 3.92 | 1.54 |
| B) 4.7 | 0.63 | — | 2.49 | 1.13 | 0.82 | 4.18 | 1.59 |

The bulk of pouring weight for the composition A amounted to 497 grams per liter and for the composition B amounted to 485 grams per liter.

The quantity of the casting powder which had to be introduced into the mold and which is to be employed for obtaining a sufficiently melted residual slag layer consisting of acid glass phase on the steel level when reaching the required block or slab height, is determined primarily by the geometric conditions of the molds while principally large block weights have a specific lower consumption than small ones, and square-shaped ones have a lower consumption than rectangular ones, and round shapes have a lower consumption than square shapes.

The following table for frequently employed mold types indicates the dependency of the quantity of casting powder from the geometry of the molds.

| Mold Type in tons | Width Head Foot in mm. | Thickness Head Foot in mm. | Height in mm. | Casting Powder Quantity per block in kg. | Casting Powder per ton Raw steel in kg. |
|---|---|---|---|---|---|
| 6 | 585–650 | 585–650 | 2,400 | 10 | 1.67 |
| 7. (7.5) | 780–840 | 580–640 | 2,400 | 12.5 | 1.77 |
| 10 | 1045–1100 | 660–720 | 2,150 | 17.5 | 1.75 |
| 11 | 1175–1230 | 625–685 | 2,150 | 20 | 1.82 |
| 12 | 1325–1380 | 640–700 | 2,150 | 22.5 | 1.87 |
| 13 | 1425–1480 | 650–710 | 2,150 | 25 | 1.93 |
| 15 | 1042–1100 | 908–980 | 2,350 | 25 | 1.67 |
| 17 | 1600–1640 | 700–760 | 2,250 | 30 | 1.77 |
| 20 | 1590–1640 | 745–825 | 2,500 | 35 | 1.75 |
| 25 | 1630–1680 | 810–890 | 2,700 | 40 | 1.60 |

Therefore, advantageously with block and slab molds having a volume of from 5 to 25 tons of raw steel, the quantity of casting powder per mold is determined by the formula:

$$P\ kg = 17.7\ kg/m^2\ (K_F m^2 + 1/10\ M_F m^2) - 7\ kg$$

In this equation:

P — Indicates the quantity of casting powder
$K_F$ — Indicates the heated surface of the steel block
$M_F$ — Indicates the mantle surface of the steel block With the great number of different mold shapes, it is advantageous to check in a simple pre-test the quantity of casting powder per mold ascertained from the above formula.

After the customary waiting time of the filled casting ladle with a discharge opening of 50 millimeters in diameter the pouring of the first group was started After the pouring, the bags with casting powder burned, and the casting powder was distributed over the entire steel surface. In the lower third of the molds, over the riser openings there formed so-called bald heads, which means the powder cover tore open, and bare steel became visable. The "bald heads" did not reach the mold wall and closed again in the second third of the mold.

If in an exceptional case the bare steel level should not be covered again by the already present casting powder and should reach the mold wall, it is advantageously not necessary to cast slower, but instead merely additional small quantities of casting powder are deposited upon the bare steel in the vicinity of the mold wall until the bare steel is covered up again.

During the rising of the steel level in the mold — it is expediently case with a rising speed of from 20 to 30 centimeters per minute — the casting powder was consumed, liquified and placed itself between the steel meniscus and the mold wall. After a casting time of 7 minutes and 10 seconds, the high mark was reached for a 12 ton raw steel block. Thereupon the casting jet was throttled and a quantity of water was applied which was sufficient to immediately quench the steel surface of the steel surface of the head on which there was lying a molded slag cover of approximately a thickness of 10 millimeters. For this purpose, a three-arm sprinkler or nozzle with bore holes spaced from each other by approximately 2 centimeters was employed from which were discharged approximately 40 liters of water per minute. The addition of water was increased by at once adding from buckets additional 10 liters of water per mold after the first quenching by the sprinkler or nozzle. The impurities and de-oxidation products which rose on the slag layer of casting powder melted onto the steel level and also rising from the steel solidified instantaneously and disintegrated in view of the occurring internal and inherent tensions into small fragments while the steel level was contacted by water.

Simultaneously, with the addition of water, steel was slowly cast further while the post casting time amounted to 4 minutes and 30 seconds. In view of the direct contact steel-water, a sufficiently thick cover of solidified steel formed, which cover withstood the pressure exerted by the differential height between funnel and steel level and did not break open.

Following the same operation, the next following groups are cast. Their casting times amounted to:

Second group casting time: 7 minutes and 40 seconds;

Post casting time: 7 minutes.

Third group casting time: 8 minutes and 30 seconds;

Post casting time: 6 minutes and 20 seconds.

After a standing time of from 140 to 165 minutes which was reduced over the hood casting of about 50%, the slabs were stripped, loaded and moved to the pit furnace dumping place. Here they were introduced into the pit furnace and heated up to rolling temperature. The slabs should be pre-blocked to pre-slabs for introduction in a coarse plate line. The shop rule is cut straignt, cut off over rolling.

After rolling to the desired dimensions, behind the shears for the melt an output of 89.2% is obtained with regard to raw steel which means an increased output by 6% over the hood casting. This advantage is also noticeable with the output of the large plate train or line.

With respect to a method or procedures for continuous casting of steel, the following additional matters are noted. With the known continuous casting of steel, the strand casting method, there is noted after the casting end which means after the casting of the steel out of the intermediate pan or casting ladle (tundish) into the ingot mold there must be removed manually by casing personnel the fluid casting slag including the casting powder remainder located upon the fluid steel level, and such removal occurs by way of skimming off before water can be given off onto the steel level for sealing off the strand end. This manner of operation leads generally to delays during operating procedure especially then when greater slag quantities or thin-fluid slag must become skimmed off. The present invention has an object to avoid these disadvantages.

A further object of the inventive is to form a sufficiently thick cover of rigid or solidified steel by way of direct and unhindered contact between the fluid steel upper surface and the water and thereby to seal off the end of the casting strand well so that upon exit of the casting strand out of the ingot mold and the zone below the ingot mold no fluid steel can become accelerated, centrifuged or spun out uncontrolled conceivably in connection with spray water of the secondary cooling, and the personnel and operational safety of the system would become endangered. Additionally, there is to be avoided a dense and clean free end of the casting strand from the hollow chambers and enclosures, and thereby the output is to become increased.

These objects are resolved by the present invention thereby that after the filling of the strand-casting ingot mold at the beginning of the casting the steel level becomes covered with a casting powder with a bulk weight of 500 through 1,000 preferably from 700 through 900 g/Liter and collective consumption of casting powder occurs in a quantity of 0.4 through 0.9 kg/t steel; accordingly at the beginning of casting and during the pouring off of the entire melt collectively; at the beginning of casting there becomes given off a casting powder layer having a height of approximately 3 cm. which is without consideration as to already melted off portions; there is a quantity of 1.5 to 3 grams per square centimeter both upper surface or in other words 4 through 9 absolute kg for a special example of the ingot mold with inner measurements of 220 × 1300 mm while the casting continuously has casting powder becoming added thereto for isolating the steel level and for lubrication or smearing the ingot mold walls; the addition of the casting powder becomes reduced against the casting and so that the slag layer lying below the casting powder layer penetrates strongly, and tne entire casting powder with the casting end is completely melted up or molted into a thin fluid slag layer; the fluid slag becomes covered completely uniformly with water and spontaneously in the ingot mold, then solidifying and immediately falling apart; furthermore a short time after the first addition of water there is water given off a second time upon the exposed steel level in a quantity amounting to three to four times the quantity of the first water addition for cooling and for sealing off the casting strand.

The advantages of this method according to the present invention accordingly can be seen therein that delays of the operating procedure become avoided when compared with the previously known manner of operation especially then when greater slag quantities or thin fluid slags must be withdrawn from the steel level in the ingot mold. A further advantage of the method according to the present invention is seen therein that by way of the direction and unhindered contact between the steel level and the water there becomes formed a sufficiently thick layer of solidified steel, and in this manner the casting strand end becomes well sealed off. Thereby, on the other hand, there becomes assured that during conveying of the casting strand out of the ingot mold and the zone below the ingot mold no fluid steel can discharge any more out of the cast strand, and the personnel and operating safety of the system would no longer be endangered. Finally, there is noted that by way of the dense end of the casting strand there is increase in output.

The foregoing features of the present invention are set forth in greater detail by way of a sample embodiment.

In a known manner there becomes poured off out of a steel casting mold or pan the finished alloy and quieted steel into an intermediate pan (tundish) that is arranged above the ingot mold of a strand casting system. Before beginning casting, there is already introduced the starting piece of the casting strand into the strand casting mold so that the mold is sealed off downwardly.

After opening of the casting discharge of the intermediate container, the ingot becomes filled with fluid steel and the steel level becomes covered with casting powder. The casting powder has a chemical composition of 20–30% calcium oxide (CaO); 30–45% silicon dioxide ($SiO_2$); 5–15% aluminum tiroxide ($Al_2O_3$); 1–10% magnesium oxide (MgO); 0–12% $CaF_2$; 0–8% sodium oxide ($Na_2O$); 0–6% $B_2O_3$; 0–3% $K_2O$; 0–6% carbon (c) with a melt-flow temperature of 1150°– 1250° C.

The starting piece of the casting strand becomes lowered slowly, and continously steel is filled into the ingot mold, and the steel level is observed by casting personnel. During the lowering of the steel strand casting powder becomes added continuously and moreover as soon as red locations so as they appear through and upon the upper surface in order to assure that isolation and insulation of the steel level. By way of the lowering of the steel strand fluid slag becomes suctioned toward the walls of the ingot mold, and thereby the smearing or lubricating effect of the slag becomes assured between the steel and the ingot mold walls.

The casting speed which means the speed with which the steel strand can become lowered is dependent upon the cast cross section of the steel strand. For small columns, bars or billets the foregoing speed for example is more than 1.8 meters per minute while the same lies from 0.4 through 1.8 meters per minute for preslabbing whereby the thickest cross section have the smallest casting speeds used therewith. If the intermediate pan or container (tundish) is still filled approximately to the half-way mark, which means that the casting end stands directly therebefore, then the addition of casting powder becomed reduced in such a manner that the slag layer and casting powder layer on the steel level becomes so thin that the fluid slag appears strongly red therethrough and shortly thereupon is molten or melted completely into a fluid slag layer of approximately 10 mm which means that no casting powder exists any more therewith.

So that as little slag as possible reaches out of the intermediate container into the ingot mold, there is noted that the casting speed then becomes reduced by 20 to 30% when the intermediate container is filled any more only to approximately one-quarter, and the intermediate container is elevated so far that one can observe the steel discharge therefrom; as soon as slag exits from the discharge of the intermediate pan or container, there becomes terminated the casting by way of closing the discharge of the intermediate pan or container.

A water layer is applied upon the fluid slag in the ingot mold by way of the casting personnel with a shower or spray in approximately 10 to 15 seconds to a height of approximately 2.5 through 4.5 cm. With an upper surface of for instance 220 × 1300 mm there becomes necessary a quantity of 10 liters of water for the first water addition to attain a water layer of 3 cm thickness or height. The fluid slag accordingly becomes covered spontaneously and completely uniformly with water whereby the slag immediately solidifies and falls apart so that no joined large or slag parts or so-called slag cakes would exist any longer, and the steel level lies free and a thin skin froms upon the steel level; this skin is stronger at the ingot mold edges where the heat dissipation is greater. The solidified slag becomes pushed manually upon this more strongly solidified steel edge so far as necessary.

Approximately 15 to 25 seconds after the first water addition, there is noted that for a second time water is given off upon the exposed steel level and particularly in a quantity which amounts to approximately three to four times the quantity of the first water addition. By way of this second water addition there is noted that the exposed steel level becomes strongly cooled so that the sufficiently thick, solidified steel layer forms on the upper surface which forms a rigid mantle in conjunction with a solidified steel layer formed on the side surfaces of the ingot mold and enclosed therein is the still fluid part of the steel.

During the first water addition upon the fluid slag with respect to the pushing away of the solidified and broken up slag and the second water addition upon the exposed steel level, there becomes adjusted advantageously the creeping step or proceeding of the strand casting machine. This means there becomes set the lowest lowering speed of the machine for example 0.2 meters per minute so that during carrying out of the noted work the machine need not be stopped or brought to a standstill.

For carrying out the operations beginning with the closing of the discharge of the intermediate container as far as to bringing forth the cast steel strand out of the ingot mold, there are required approximately 2.5 to 3.0 minutes.

There is noted that statements as to the casting powder used during strand casting differ respectively overlap with respect to the powder used during ingot mold casting with respect to bulk weight as well as utilized quantity and chemical composition. There is believed that the foregoing should be clear for the average man skilled in the art. For further clarification reference can be made to the following table.

| | PARENT APPLICATION Ser. No. 306,715 | NEWLY ADDED |
|---|---|---|
| BULK WEIGHT: | 250 – 750 | 500 – 1000 |
| CONSUMPTION: | 1 – 3 | 0.4 – 0.9 |
| MELT-FLOW TEMPERATURE: | 1260 | 1150 – 1250 |
| ANALYSIS OF CASTING POWDER: | | |
| CaO % | 20 – 30 | 20 – 30 |
| $SiO_2$% | 42 – 50 | 30 – 45 |
| $Al_2O_3$ % | 8 – 14 | 5 – 15 |
| MgO % | 3 – 8 | 1 – 10 |
| $Na_2O$ % | 0 – 6 | 0 – 8 |
| or | | |
| $B_2O_3$ % | 0 – 6 | 0 – 6 |

-continued

| | PARENT APPLICATION Ser. No. 306,715 | NEWLY ADDED |
|---|---|---|
| $K_2O$ % | 0 – 3 | 0 – 3 |
| $CaF_2$ % | | 0 – 12 |
| C % | | 0 – 6 |

For further clarafication, refererence can be made to Page 184 out of a book, "Strand Casting," by Dr. Ing. Waldemar Schwarzmaier (published by Berliner Union Stuttgart) as well as Volume 5, Pages 631–633 of LIXIKON DER HÜTTENTECHNIK disclosed by Hans Grothe with co-working by Ludolf Engel, Heinrich Hock, Karl Löhberg, and Karl Schönert (publsiher: Deutsche Verlags-Anstalt Stuttgart). (Photocopies of Pages 184 and 631–633 are attached).

The object and other objects and advantages of the present invention will appear more clearly from the following specification in connection with the accompanying drawings, in which:

FIG. 1 represents a method of normal continuous casting involving casting powder addition with a powder thickness of approximately 30 mm.

FIG. 2 illustrates the method with a mold having a layer of almost fully molten casting powder, approximately 10 mm thickness.

FIG. 3 represents the method with a mold during any first water addition, water-thickness of approximately 30 mm such that the slag-layer solidifies, disintegrates into small fragments and lifts off from the steel-level.

FIG. 4 illustrates the method with a mold involving second water-addition for cooling and sealing off the cast strand.

Figure 5:
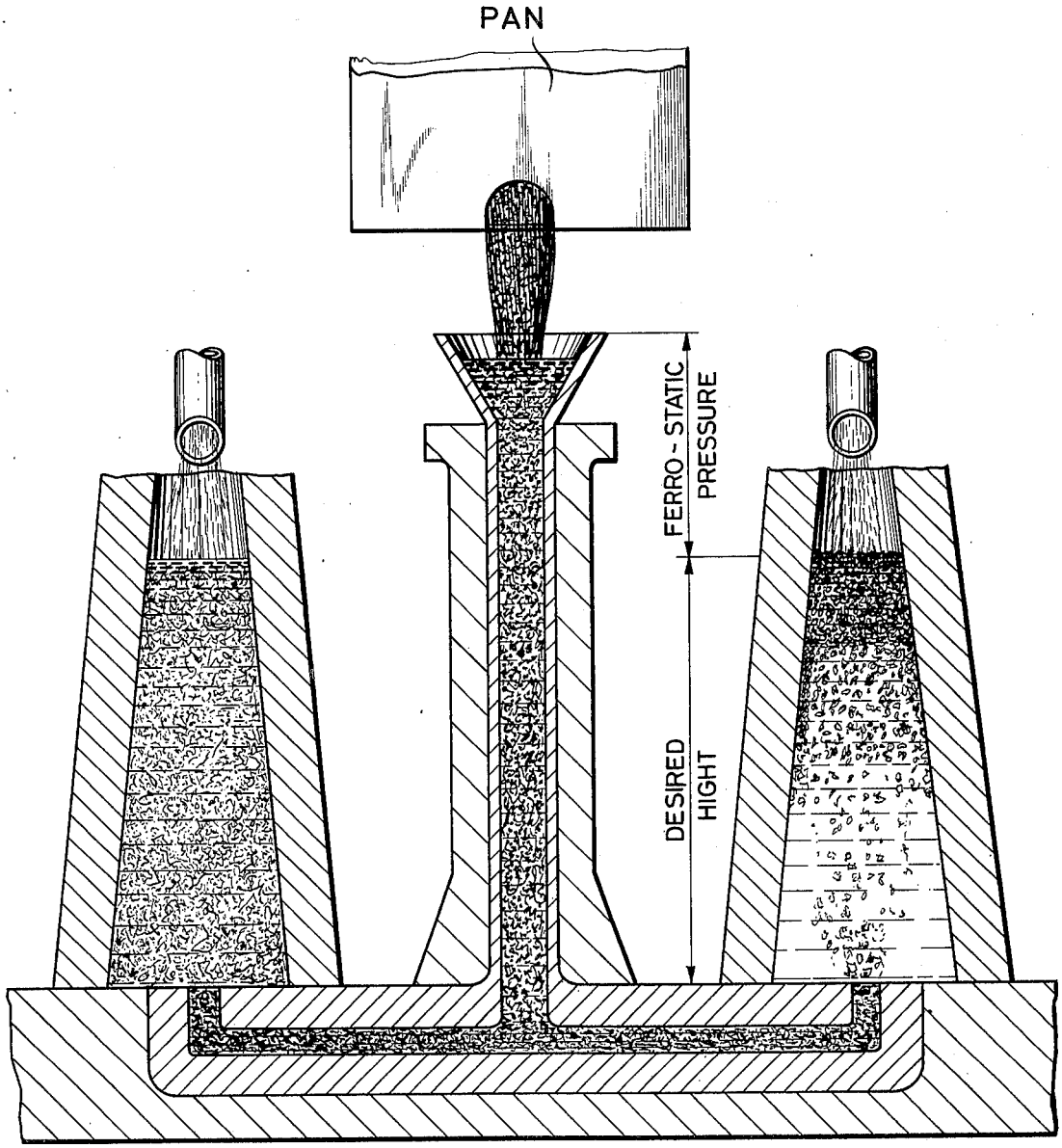
FIG. 5 illustrates diagrammatically and collectively features used with the method of the present invention.

In the views of FIGS. 1–4, inclusive, there is provided illustration of a pan or tundish 1 including a submerged nozzle 2 located relative to a mold 3 in which there is liquid steel and casting powder 5 thereon subjected to a water spray 6.

The accompanying illustation of FIG. 5 represents the method diagrammatically at least in part. Reference will be made thereto in subsequent paragraphs.

The present invention involves a combination of the casting of killed (melt), stabilized or calm steel subject to utilization of an accurately defined casting powder in a particularly quantity and the so-called "water casting".

The foreign German disclosure 1,289,961 — Behrens et al discloses a method for casting of molten steel into blocks subject to utilization of an insulating or exothermic hood and cover of the block head (top end of an ingot or ingot crop end) by way of a shrinkage or contraction powder with which the block head (top end of ingot or ingot crop end) after solidification of between 70 and 95% of the steel becomes quenched with water. In comparison with the method according to the invention, there is required neither any insulating respectively exothermic hood or covering nor shrinkage or contraction powder but rather a *casting powder* is used with the present invention whereby the steel *immediately* upon attaining the desired level or height becomes covered completely with water which means the collective conditions differ essentially from each other in both cases; in the known prior art case the conditions involve a rigid situation and in the case according to the present there is a liquid or fluid condition involved so that more than only a time difference would be provided. The differences between the casting powder and the shrinkage or contracting powder obviously would not have to be discussed in further detail. Additionally, with the previously known method of Behrens et al there cannot be attained the upper surface of the ingot which would correspond to increased demands or requirements; this would correspond much more only to those situations which are attained with water casting or with "hood casting" literally that can be designated more specifically according to the terminology of the art as "hot top casting" without casting powder.

The working of column 1, lines 19, etc. of this foreign German disclosure would concern the already stated known method considered in the introductory paragraphs of the present description as to the "water casting" known for decades with which even subject to utilization of different auxiliary or aiding measures would not make possible production of any qualitatively set upper surface.

With the previously known method of the foreign German disclosure, there is attained only an upper surface which would be attained corresponding to that obtainable with water casting respectively hood casting or in other words, this upper surface would not be satisfactory or sufficient to meet the higher or increased requirements. Additionally, according to the known method, there are required considerable waiting periods of time, according to the sample embodiment in column 2, line 67, of the foreign German disclosure, requiring 160 minutes compared with approximately 70 to 90 minutes with approximately equal block or ingot size according to the present invention, and this means that approximately twice as long a standing time would be necessary. No further detailed comment would be necessary as to the meaning of two time longer standing time during production several thousand tons daily in steel production. Furthermore, there is noted that with hood casting or hot top casting generally aside from the additional loading by way of the hood or top, there would be required at least twice the quantity of casting powder as with the method according to the present invention.

The introductory paragraphs already set forth in detail the method of water casting noted in column 1, lines 19, etc. of the foreign German reference. These statements are confirmed by way of the comments in column 1, lines 26, etc. of the foreign German disclosure, and these are supplemented by setting forth additional disadvantages. There cannot be attained according to the water casting method an upper surface quality and a corresponding production as realized with the method according to the present invention.

As to the inventive height of the method according to the present invention, attention can be directed to the following features. The essential steel casting methods for practice that are set forth in detail in the introduction of the description with their disadvantages and advantages, namely the water casting on the one hand and the hot top casting with casting powder on the other hand have been known for decades to the average man skilled in the art just as casting powder has been known. Aside from both of these known basic methods, there were carried out a multiplicity of attempts with differing means in order to combine or unify the main advantages of both of these methods while simultaneously avoiding the disadvantages thereof in some manner.

The multiplicity of the attempts which failed would be attributable mainly thereto that a prejudice existed against utilization of casting powder and a quenching with water carried out immediately after termination of casting; this prejudice would be based upon the following three factors including:

a. on the one hand, by way of fear that the block or ingot would become hollow rather than dense as set forth in column 1, lines 26 etc. of the foreign German disclosure;

b. the concern that the fluid or liquid steel would break through the thin covering formed at the head end or ingot top; and c. on the other hand, the further fear and concern that the reactions between the water quantity applied and the fluid slag could not be controlled.

Not until disclosure of the present invention could this prejudice be overcome. The problem setting or objects accordingly have been known for a long time as a goal sought for a long time in the known field of endeavor of steel casting. A solution hereto, however, has not been previously disclosed. Particularly in such a case, however, there must be noted that the inventive height of a combination of features of the present invention must be recognized as to inventive height thereof.

The combination of method steps even if known in part has proven successful by way of the straight forwardness and purposefulness thereof already in practice.

All references known in the prior art protect manner of operation which either would be derived from the previously known "water head or top" casting method or derived from the hot top casting method equally as well known previously. In none of the patents was there protected any method to resolve the object or goal of having water upon a *fluid slag of casting powder*. Likesise, in none of the patents has there been mentioned the complete water top casting method which also includes the post-casting of steel. The post-casting through the funnel compensates shrinkage of the steel caused by way of the cooling off thereof. The combination of the present invention moreover cannot be carried out with every casting powder which agrees or is compatible with the steel. There are only predetermined powders to be used which form predetermined slags and upon addition of water in molten liquid condition completely makes possible and free the access of the water to the steel. Additionally there is required furthermore a predetermined water-adding technique.

The concern of the present invention involves not only a compatibility with the cast steel but rather also the concern is with the desired reaction of the *molten* powder with the water.

The hanging up of the powder in the ingot mold in a magnitude is not the present invention but rather represents a disclaimed part of the present method when optimum results are to be attained. The same is true as to disclosure with which the concern, however, is not with casting powder but rather with an insulating lid which covers the level (bath level or surface) of the steel in the ingot mold.

The addition of water to the insulating powder upon the raw ingot or block has absolutely no relationship with the teaching of the present method. U.S. Pat. No. 2,401,075—Humes covers the cast steel under conditions in the ingot mold with lumpy anthracite or other rock blocks in order to reduce the heat radiation of the ingot upper surfaces toward the casting. The ingot top, which additionally is insulated by way of hoods, is to be kept fluid so long in order under different non-metallic influences not to offer the possibility of rising out of the ingot internal portion into the block top or head portion. Not until the largest part of the non-metallic constituents have risen does any quenching of the upper surface with water occur in order to obtain a strong cover which can withstand the pressure of the stripper piston, punch or die. So one can already strip when the core of the ingot is still fluid.

With the present invention entirely different procedural steps serve to release water onto the *completely molten* casting powder slag directly after termination of casting and the water is cast upon the still completely fluid steel in the ingot mold. The water is to lift the slag from the steel and is to cool the steel momentarily at the upper surface in order to make possible post-casting or casting subsequently thereto. This can be designated as the complete opposite of the teaching of the U.S. patent of Humes.

In German steel works there occurs that contrary to American conditions during steel application there would exist small movable magnitudes. As a consequence thereof, the different steel works in the casting pits have installed a multiplicity of different ingot mold types. There can occur furthermore therewith that to the regret of the steel worker, these ingot molds only can be permitted to be filled to a predetermined height. The filling grade of the ingot molds can fluctuate accordingly between approximately 80 and 100%. The expression "desired height" could possibly be translated from the German to be more readily understood by referring to *desired steel level in the mold.*

When the water is added there should no longer exist any remainder of unmolten powder. The powder must have been transformed completely into the fluid slag. Powder remainders hinder a momentary quenching of the steel upper surface by way of the water. At this location, the steel becomes insulated and breaks through during subsequent casting on the basis of the ferro-static pressure. In place of the wording "melted down" the more specific wording *melted out* can be used.

The German wording "Steigendes Giessen" can be translated as "uphill casting" but as an alternate meaning can be designated as bottom pouring. Similarly, the German wording "Haubenguss" previously noted as hood casting should be given alternate meaning as *hot top casting*. The German wording "Kokillenhaube" previously noted as "mold hoods" has alternate meaning designated as *hot top*. The German wording "Blockkopf" translated literally as "block head" alternately has a more specific meaning in this art as *ingot top*. German wording "Massekopfe" was previously noted as "mass heads." These are the same as "Kokillenhauben" alternately and preferably to be translated as *hot tops*.

There is noted the already known "Haubenguss" designated in English preferably as hot top casting in order subsequently to distinguish the present method therefrom as set forth in the present specification. There is meant that so much powder must be released or given off that during entry of the steel into the hood or hot top there must still be sufficient quantity of powder existing so that the entire upper surface of the steel is covered with powder. Thereby the steel is insulated sufficiently against heat radiation. This good insulation of the steel in the insulating hood or hot top area and below the insulating powder layer maintains the steel in a fluid condition for a very long time which is longer than the time with the previously described water casting. Thereby there is avoided the formation of "thread shrinkage" or "contraction" going very deep, but also a large steel quantity is taken through the area of the insulating hoods or top area which must be scrapped after the rolling thereof. And particularly this is that which is to be avoided with the present inventive method without having to do without the advantages of the casting or pouring below powder for attaining a good upper surface.

As to how the powder is introduced and utilized, attention should be directed to the text.

The powder bags or crucibles are hung up on cables or chains in the noted spacing or distances from the bottom of the ingot mold (the bags are thus "hung up" rather than "introduced"). The powder thereby has a preferred specific weight. The same is given off in the preferred quantity. The quantity is so matched to the desired ingot weight that all powder is completely molten upon attaining the required weight though, however, still existing in sufficient quantity in order to encapsulate the steel completely on the upper surface thereof. The casting powder must be completely molten upon reaching the desired level or height of the steel level in the ingot mold. There cannot be any powder remainder existing. Everything must be transformed into a fluid slag.

The method of U.S. Pat. No. 2,402,833— Mumma et al first of all is a "water casting" method without the utilization of casting powder. Mumma et al, however, does not want to encounter the danger of thread contractions or hairline shrinkage. Mumma wants to offer the possibility that after the quemching of the steel on the upper surface sufficient heat or warmth remains below the formed lid or cover. So there is to be made possible the flowing in of fluid steel below the lid or cover and shrinkage or contraction can arise during such flowing in. Since, however, Mumma does not want to accept the lost top of the fluid or top casting and on the other hand wants to maintain the hot top warm, Mumma et al after water release and the cover formation connected therewith provides an insulating means upon the steel cover. For this purpose, Mumma et al takes sand, rock powder, burned calcium, limestone or dolamite powder, carbon dust, fine coal, straw, cork, or other similar materials. Also this method has no relationship with the teaching of the present invention. The method of the present invention is distinguishable from the methods known in that there is casting with a casting powder which is transformed completely into fluid slag during the casting.

The present invention involves the giving off of water onto the fluid slag. Thereby the slag becomes rigid or solidified momentarily, breaks up and splinters up and permits the water to reach the steel freely which likewise becomes rigid on the upper surface thereof. So the steel can be subsequently cast or there can be post-casting of the steel and thereby on the basis of the ferro-static pressure causing a hollow chamber by way of the shrinkage of the solidifying steel (called contraction or shrinkage) there is possible the compact casting of the steel. This subsequent casting by way of a funnel during steel cast in a rising manner is not mentioned, suggested or in any way disclosed by any prior art.

The ferro-static pressure results from the difference in height between the funnel and steel level in the ingot mold.

The present invention involves a specific combination of particular method features on the one hand as to the so-called hood casting method with on the other hand such water casting method whereby the advantages are retained and the disadvantages thereof, however, are avoided.

The quantity of water (1–1.5 liter, more than conventional with water casting) in comparison to the water casting cannot be specified any more accurately because there does not exist any more generally valid quantity for water casting. The same depends upon the size of the block upper surface, upon the ratio of the surfaces of narrow and wide sides to each other, upon the height-width ratio or relationship of the sides, upon the steel mass in relationship to the mass of the ingot mold, upon the steel quality, the water supply speed and the water temperature. The necessary water quantity can be brought forth for the operation only on the basis of tests. With the method of the present disclosure, there must be given up beyond this value 1–1.5 liter water per kg. slag in order to be able to take up the heat capacity of the slag.

There is noted that the casting occurs parallel to the strand casting because the concern therewith likewise is with quieted steel. The water addition occurs thereby only toward the end of the casting procedure at the strand end after the slag is withdrawn. According to the present method, the slagging-off or withdrawal of slag can be disregarded.

The powder to be given off is dependent in its quantity upon the size of the surface on which the same comes into contact with the liquid steel. These surfaces are the head surfaces and the mantle surfaces. The molten powder drops itself between the block and ingot mold during the casting of the head surface in the gap created by way of shrinkage. For different block types there was transmitted the active consumption as to powder. From the existing reproduceable values there resulted purely in a calculated manner the quantity as to the linear function of the surfaces as set forth in the formula. The difference between the hot and cold masses of the block can be disregarded because of the nominal nature thereof. The required values represented by the formula have been proven to be correct in the operational use thereof.

By way of giving off the water there is noted that the slag layer becomes solidified and lifts itself from the steel upper surface (this does not occur with every slag). Previously there has been only knowledge of the slag of the type which permits realization of the lifting off from steel. This can occur with several types and depends upon the technique of setting the objects relative to which the water is supplied. Thereby, it can happen that the slag "dances" as an undisturbed cover upon the boiling water. There can be that the slag inflates like cauliflower. The same, however, also can become shattered and can have water flowing therebelow. With the method of the present invention there was always attained the latter and optimum condition.

It is important that the slag and steel become separated from each other and that the water can completely quench the steel on the upper surface thereof, since in those cases where slag binds further on the steel, there must be noted that steel breaks through during post-casting. Thereby the upper surface quality of the steel becomes worse and the post-casting is made more difficult or impossible. For the covering capability there can arise a hindering or endangering by way of spitting steel, spray or water vapor puffing or vaporization.

For attaining an optimum quality of the block upper surface, it is better to hand the bag with the casting powder in the ingot mold and not to place or lay the same upon the bottom. How high the bag hangs over the bottom is dependent upon the block size. With the known and most frequent measurements there is recommended a spacing of 5–50 centimeters. This is known from the literature about block casting and contributes also with the present method for optimum results.

The connections or inter-relationships between water supply or addition and quenching of the slag and the lifting off of the solidified slag from the steel connected therewith has been explained.

A typical feature of the present method concerns the additional water requirement because the slag which does not exist with water casting must be additionally quenched. For quenching of a kilogram of slag there is necessary 1–1.5 liter water because of the temperature difference between slag-water and because of the steam or vaporizing heat of the water.

For definition of the formula there is stated the following:

P is the quantity of casting powder in kg;

$K_F$ is the surface of the block head in $m^2$;

$M_F$ is the surface of the block mantle in $m^2$; (the surfaces of both narrow and wide sides).

The quantity is linearly dependent upon the contact surface. The measures are those of the block, dependent upon the temperature, since the error which can result by way of temperature difference is negligibly small.

The temperature of 1260° C is the temperature of the beginning of the melting flow of the casting powder.

A combination of the advantages of hood casting and water casting should be attained without having to accept any of the disadvantages of either. Both methods are separately known, and the same daily are utilized in operational practice. However, the recognition or knowledge of both methods does not permit utilization thereof for creation of a third method consisting of $x$% in proportion of the method No. 1 and of $(100-x)$% in proportion of the method No. 2. There have been carried out tests in this direction for several years before finding a powder which dissolves from steel by way of water addition and simultaneously guarantees the upper surface quality of the steel. Further it was necessary to develop the correct and proper water-addition technique.

The foreign German patent 1,289,961— Behrens et al and the foreign British patent 967,032— Daussan were known. The Behrens et al patent is not related to the teaching of the present invention because the water addition after a standing time of 180 minutes occurs when 70–95% of the block means are solidified. This then no longer provides any liquid slag. With the present invention, however, there is giving off at te time point zero after casting of the water upon a completely liquid slag. The procedure is the main part of the invention. The addition must be controlled. The same is not mentioned or covered previously in any of the known patents in the U.S. or in foreign countries.

The foreign British patent 967,032— Daussan has in common with the present method only that a powder is suspended in the ingot mold without accurate statements as to the spacing from the bottom. The present invention is in no way involved with the suspension mechanism. Both known powder compositions are not comparable with the powder used with the present method.

The composition "A" contains 15–20% free carbon. The powder used with the present invention has no carbon. The carbon hinders the formation of a glazed or glassy slag which shows the necessary reaction with water addition.

The composition "B" contains 20–30% cellulose waste. The powder used with the present invention cannot contain such cellulose waste because after burning of the cellulose the ash remainders would undermine the sought quenching effect. Both sorts of powder have a completely different object than the powder of the present method. Daussan seeks to attain heat insulation and to create a reducing atmosphere over the steel level in the ingot mold by way of burning off the cellulose, respectively, carbon. With the present invention there is striving to surround the block with the slag and to release the surrounding slag again from the steel by way of water addition at the end of the casting. The supply or the addition of water to the powders of compositions A or B may bring about the displacement of the last steel plant worker out of the operation because in a moment the addition of quantities of dust can be whirled up and each vision can be taken from such worker.

With the tests for development of the present inventive method, there had to be experience gained with comparable powders. There is believed it is not true that the powder quantities necessary in the present method which could be derived from the formula would show no difference relative to the necessary quantities involved withthe Daussan patent disclosure. Daussan requires 1000-1500 grams per ton of steel. With the present invention quantities do not pertain to the weight of the block but rather the quantities pertain to the upper surface thereof. The surface is dimensioned with $m^2$ "square meters," the weight becomes developed out of the volume and is dimensioned by a power higher with $m^3$"cubic meters."

Herefrom there can be ascertained the different quantities dependent upon upper surface and volumes with the individual methods. Additionally, there is noted that in the method of Daussan there are minimum quantities prescribed which are unlimited toward the top. The quantities of the present invention can be increased only nominally since the same must be molten without any remainder as at the end of the casting because otherwise the quenching with water would fail.

With respect to the quantity of water used in the water casting process, there is noted that this is dependent on many factors, as explained previously, so tht any definite quantity can only be determined when the various quantitative factors are known. There has been found that having determined how much water would normally be used in a given mold in the water csting process, the present new method requires 1 to 1.5 liters per kilogram of slag more.

The reference to continuous casting has been clarified.

The process in German patent No. 1,289,961—Behrens involves applying water after the slag and steel has substantially hardened. The novelty in the present inventive process includes covering the slag layer with water while the slag and metal are still liquid, which action causes the slag layer to separate from the metal, and allows the water to contact the metal underneath the slag layer.

The molten metal is introduced at the bottom of the mold, and the water is added to the liquid slag. Further included is the use of carbon-free casting powder. This form of powder has proved particularly efficacious in this process. The formation of the slag layer is noted along the walls of the mold as well as at the top.

The present invention has the objective quickly to remove the casting slag after termination of the strand casting procedure and to do so as completely as possible. The most important steps therefore are the reduction of the casting powder addition toward the end of casting so that still only molten slag exists and there exists the spontaneous and completely uniform covering of this fluid slag with water in order to obtain the desired slag disintegration.

The present invention concerns a method for continuation casting of quiet steel in a strand with which casting powder becomes introduced upon the steel level and during the casting operation casting powder becomes added continuously for isolation of the steel level and for lubricating the mold walls. The concern involves the noted quantity of 0.4 through 0.9 kg/ton steel as to the entire added quantity of casting powder, which means over the entire duration of the casting off.

At the beginning of the casting there becomes given off a height of approximately 3 centimeters casting powder layer with respect to this 0.4 through 0.9 kg/ton steel. There is noted that the values of 1.5 through 3g/cm² bath upper surface or 4 through 9 kg pertain to a strand casting mold used in practice and having inner measurements of 200 × 1300 mm. These values are to be considered to be included with the sample embodiment though having more subordinate meaning.

The following represents another example of a composition representing modification of components and melting flow temperature being changed in part.

Ser. No. 530,400

| | | | |
|---|---|---|---|
| Bulk weight g/l : | 250 – 750 | 500 – 1000 | 500 – 1000 |
| Consumption kg/t : | 1 – 3 | 0.4 – 0.9 | (total 0.4 – 0.9 |
| Melt-flow temperature ° C : | 1260 | 1100 – 1250 | 1150 – 1250 |
| Analysis of the casting powder : | | | |
| CaO% | 20 – 30 | 25 – 35 | 20 – 30 |
| $SiO_2$% | 42 – 50 | 20 – 45 | 30 – 45 |
| $Al_2O_3$% | 8 – 14 | 5 – 15 | 5 – 15 |
| MgO% | 3 – 8 | 1 – 10 | 1 – 10 |
| $Na_2O$% | 0 – 6 | 0 – 8 | 0 – 8 |
| or | | | |
| $B_2O_3$% | 0 – 6 | 0 – 6 | 0 – 6 |
| $K_2O$% | 0 – 3 | 0 – 3 | 0 – 3 |
| $CaF_2$% | — | 0 – 12 | 0 – 12 |
| C | — | 0 – 10 | 0 – 6 |

It is, of course, to be understood that the present invention is, by no means, limited to the specific example set forth above, but also comprises any modification within the scope of the appended claims.

We claim:

1. A method for continuous casting of quiet steel into a strand, comprising the step of: covering the steel level after filling the stand casting mold at the beginning of casting with a casting powder having a bulk weight in a range of 500 to 1000, preferably 700 to 900 grams per liter, the collective consumption of casting powder occurring in a quantity of 0.4 to 0.9 kg per tone steel, continuously during the casting adding casting powder for insulation of the steel level and for smearing the mold walls, reducing said adding of casting powder toward the end of the casting so that a slag layer lying below the casting powder layer shines strongly red therethrough and melting the entire casting powder completely at the end of the casting into a thin fluid slag layer, covering the fluid slag in the mold spontaneously and completely uniformly with a supply of water so as to solidify the slag layer and immediately cause it to fall apart, and a short time after the first water supply giving off water a second time upon the exposed steel in a quantity three to four times the first water supply for cooling off and sealing the casting strand.

2. A method according to claim 1, in which there is a step of shifting away of the slag that solidified and fell apart.

3. A method according to claim 2, in which there is a step of utmost minimizing of lowering speed of the strand casting plant during the carrying out of the first water supply, during said shifting away of the slag and during said giving off of the water the second time.

4. A method according to claim 1, in which there is a step of introducing of the casting powder with a composition of 20 to 30% CaO
30 to 45% $SiO_2$
5 to 15% $Al_2O_3$
1 to 10% MgO
0 to 8% $Na_2O$
0 to 6% $B_2O_3$
0 to 3% $K_2O$
0 to 12% $CaF_2$
0 to 6% C and with a temperature in a range of 1150° C to 1250° C when entering into a melting flow upon the fluid steel level in the mold.

5. A method according to claim 1 in which at the beginning of casting and during pouring off of the entire melt collectively at the beginning of casting there is a step of giving off a casting powder layer having a height of approximately 3 cm without consideration as to portions already melted off.

6. a method according to claim 5 in which there is a step of providing a quantity of 1.5 to 3 gram per square centimeter bath upper surface,

7. A method according to claim 6 in which there is a step of providing quantity of 4 through 9 absolute kg for an ingot mold.

8. A method according to claim 7 including a step providing the ingot mold having measurements of 220 × 1300 mm specifically.

* * * * *